US008074695B2

(12) United States Patent
Sekiya et al.

(10) Patent No.: US 8,074,695 B2
(45) Date of Patent: Dec. 13, 2011

(54) ADHESIVE TRANSFER DEVICE

(75) Inventors: Nobuyuki Sekiya, Tokyo (JP); Masatsugu Yamaguchi, Tokyo (JP); Masashi Tanaka, Tokyo (JP); Takashi Kawakami, Uji (JP)

(73) Assignee: Nichiban Co., Ltd., Tokyo (JP)

( * ) Notice: Subject to any disclaimer, the term of this patent is extended or adjusted under 35 U.S.C. 154(b) by 232 days.

(21) Appl. No.: 12/598,821

(22) PCT Filed: May 7, 2008

(86) PCT No.: PCT/JP2008/058796

§ 371 (c)(1),
(2), (4) Date: Nov. 4, 2009

(87) PCT Pub. No.: WO2008/140088

PCT Pub. Date: Nov. 20, 2008

(65) Prior Publication Data

US 2010/0084095 A1 Apr. 8, 2010

(30) Foreign Application Priority Data

May 9, 2007 (JP) ..... 2007-124134

(51) Int. Cl.
*B32B 15/00* (2006.01)

(52) U.S. Cl. ..... 156/540; 156/378; 156/391; 156/230; 156/234; 156/238

(58) Field of Classification Search ..... None
See application file for complete search history.

(56) References Cited

U.S. PATENT DOCUMENTS 7,784,517 B2 * 8/2010 Sakanishi ..... 156/540
2007/0009307 A1 1/2007 Kai et al.

FOREIGN PATENT DOCUMENTS

JP 11-227386 8/1999
JP 2007-001101 1/2007
WO WO 90/14299 11/1990
WO WO 2004/065072 A2 8/2004

OTHER PUBLICATIONS

English translation of International Preliminary Report on Patentability and Written Opinion of corresponding International Application No. PCT/JP2008/058796, mailed Dec. 3, 2009.
International Search Report of corresponding International Application No. PCT/JP2008/058796, mailed Oct. 7, 2008 (English translation).
International Search Report of corresponding International Application No. PCT/JP2008/058796, mailed Oct. 7, 2008.

* cited by examiner

*Primary Examiner* — Kimberly K McClelland
(74) *Attorney, Agent, or Firm* — Alston & Bird LLP

(57) ABSTRACT

An adhesive transfer device can reliably transfer by simple operation an adhesive onto a transfer target surface by either of spot-like transfer and linear transfer that are alternately selected. The adhesive transfer device has a supply reel (20) around which a transfer tape (1) having a backing material (2) provided with an adhesive (3) on one surface thereof is wound, a take-up reel (30) for taking up the transfer tape, and a transfer head (40) for transferring the adhesive onto the transfer target surface. The transfer head is pivotally supported at one end thereof and includes a first transfer section (45*a*) formed at a free end portion thereof and having a circular arc-shaped contact surface for mutual contact with the transfer target surface, a second transfer section (45*b*) having a flat transfer surface (45*c*) between the first transfer section and a pivot portion of the transfer head, and a spring member (46) for urging the free end portion of the transfer head toward the transfer target surface. Pressing the second transfer section onto the transfer target surface against the resilience of the spring member performs spot-like transfer of the adhesive onto the transfer target surface. Linear transfer of the adhesive onto the transfer target surface is performed by moving the first transfer section with the first transfer section pressed to the transfer target surface by the resilience of the spring member.

14 Claims, 11 Drawing Sheets

ADHESIVE TRANSFER DEVICE

TECHNICAL FIELD

The present invention relates to adhesive transfer devices, and more particularly to such an adhesive transfer device, which is capable of performing either of spot-like or point-like transfer and linear transfer of an adhesive carried on a backing material.

BACKGROUND ART

Conventionally, transfer tapes having an adhesive carried on one surface of a backing material have been used for pasting posters, pictures and the like or sealing envelopes. The transfer tapes are wound around a reel and set in a case of a transfer device before use.

The transfer device for transferring the adhesive from the transfer tape onto a transfer target surface includes a case having contained therein a rotatable supply reel around which a transfer tape having an adhesive provided on one surface of a backing material is wound, a rotatable take-up reel for taking up a portion of the backing material unwound from the supply reel, and a transfer head for transferring the adhesive of the transfer tape unwound from the supply reel onto the transfer target surface and having a flat transfer surface.

One example of such transfer device is disclosed in Japanese Patent Laid-open Publication (JP-A) No. 11-227386, which can perform spot-like transfer of the adhesive of the transfer tape to the transfer target surface by bringing the transfer head into contact with a desired position on the transfer target surface and compression deforming an elastic member of the transfer head by pressing. When performing linear transfer of the adhesive to the transfer target surface, a corner edge of the transfer surface is brought into contact with the transfer target surface and the body case of the transfer device is moved in a direction parallel to the transfer target surface with the body case pressed in a direction toward the transfer target surface.

Another example of the transfer devices is disclosed in International Publication (WO-A1) No. 2006-516931, which comprises a transfer head including a plurality of rollers that are rotatable about substantially parallel axes spaced apart from one another, and a closed-loop belt that is trained about the periphery of the rollers.

DISCLOSURE OF INVENTION

Problems to be Solved by Invention

The transfer device described in JP 11-227386 A1 needs to be inclined relative to the transfer target surface during linear transfer operation so as to ensure that the corner edge of the flat transfer surface can move in a direction parallel to the transfer target surface with the corner edge pressed onto the transfer target surface. Movement of the transfer device while being kept in an inclined position renders a contact state in a width direction of the transfer tape unstable, which will result in insufficient transfer of the adhesive to the transfer target surface. Furthermore, since the corner edge of the flat transfer surface is forced against the transfer target surface, the transfer surface may be damaged due to application of excessively large force or pressure to a small area of the transfer target surface.

The transfer device described in WO 2006-516931 A1 allows the transfer head to be pressed onto the transfer target surface with a small force as compared to the transfer device of JP 11-227386 A1 because of the transfer head which is composed of a plurality of rollers that are rotatable about substantially parallel axes spaced apart from one another, and a closed-loop belt that is trained about the periphery of the rollers. However, due to the structure of the transfer head including the closed-loop belt trained around the periphery of the plural spaced rollers, the transfer device described in WO 2006-516931 A1 can encounter a problem that when the flat transfer surface of the transfer head is pressed onto the transfer target surface for performing spot-line transfer of the adhesive, part of the closed-loop located between the adjacent rollers tends to distort in a direction away from the transfer target surface, which will bring about insufficient transfer of the adhesive to the transfer target surface.

The present invention has been conceived in view of the foregoing problems and is aimed at the provision of an adhesive transfer device which can reliably transfer by simple operation an adhesive onto a transfer target surface by either of spot-like transfer and linear transfer that are alternately selected.

Means for Solving the Problems

To solve the foregoing problems, the present invention provides an adhesive transfer device which includes a case, a supply reel rotatably mounted to the case and having a wound supply of transfer tape wound thereon, the transfer tape having a backing material and an adhesive provided on one surface of the backing material, a take-up reel rotatably mounted to the case for taking up a portion of the backing material of the transfer tape unwound from the supply reel, and a transfer head mounted to the case for transferring the adhesive of the transfer tape unwound from the supply reel onto a transfer target surface, characterized in that said transfer head has one end pivotally connected to the case and includes a first transfer section provided at a free end portion of the transfer head and having a circular arc-shaped contact surface for mutual contact between the first transfer section and the transfer tape, a second transfer section disposed between the first transfer section and a pivot portion of the transfer head and having a flat transfer surface, and a spring member for urging the free end portion of the transfer head toward the transfer target surface, wherein the transfer head is configured to selectively perform either of spot-like transfer of the adhesive onto the transfer target surface by first pressing the second transfer section onto the transfer target surface against the resilience of the spring member and subsequently moving the second transfer section back away from the transfer target surface, and linear transfer of the adhesive onto the transfer target surface by moving the first transfer section with the first transfer section pressed onto the transfer target surface by the resilience of the spring member.

With the adhesive transfer device thus arranged, the second transfer section is pressed onto the transfer target surface against the resilience of the spring member and subsequently the second transfer surface is moved back away from the transfer target surface whereupon that part of the adhesive of the transfer tape which has been pressed onto the transfer target surface by the flat transfer surface of the second transfer section is transferred to the transfer target surface in a spot-like state. Furthermore, the transfer tape unwound from the supply reel is continuously pressed by the first transfer section onto the transfer target surface by moving the first transfer section with the first transfer section pressed onto the transfer target surface by the resilience of the spring member, so that the adhesive of the transfer tape is transferred onto the transfer target surface in a linear fashion.

The first transfer section may be fixedly mounted to the transfer head provided that the transfer surface is shaped into a circular arc. However, it is preferable according to the present invention that the first transfer section comprises a roller rotatably mounted to the transfer head.

This arrangement ensures that the first transfer section can move smoothly on the transfer target surface after it is pressed onto the transfer target surface.

Preferably, the flat transfer surface of the second transfer section is formed by an elastic plate member.

With this arrangement, when the transfer surface of the second transfer section is pressed onto the transfer target surface, it is possible to take up or cancel out surface irregularities of the transfer target surface by a synergetic effect generated by the resilience of the spring member and the elastic deformation of the elastic plate member.

It is preferable according to the invention that a slippery cover member for smoothening movement of the transfer tape is attached to each of the transfer surface of the second transfer section and that part of the transfer head which excludes the first transfer section and which is subjected to mutual contact with the transfer tape.

With this arrangement, contact friction between the transfer head and the transfer target surface can be reduced, which will insure smooth movement of the transfer tape.

According to the invention, the adhesive transfer device may further comprise a take-up mechanism for taking up the transfer tape around the take-up reel when the second transfer surface is moved back away from the transfer target surface. Preferably, the take-up mechanism includes a sector gear mounted coaxially with the pivot portion of the transfer head, a supply gear that can mesh with the sector gear and is mounted coaxially with a cylindrical body of the supply reel for transmitting a rotary motion to the supply reel only in an unwinding direction of the transfer tape, a driving gear mounted coaxially with the supply gear, and a driven gear held in driven mesh with the driving gear via an intermediate gear and mounted coaxially with a cylindrical body of the take-up reel.

With this arrangement, the transfer surface of the second transfer section is first brought into contact with the transfer target surface and subsequently forced against the transfer target surface during which time the transfer head pivots in a direction to turn the sector gear in the same direction. The sector gear comes into meshing engagement with the supply gear mounted coaxially with the cylindrical body of the supply reel and turns the supply gear and the driving gear concurrently while the supply reel is kept immovable against rotation. With this rotation of the driving gear, the driven gear mounted coaxially with the cylindrical body of the take-up reel is driven via the intermediate gear to rotate in a direction to ensure that a portion of the transfer tape extending between the transfer head and the take-up reel is taken up around the take-up reel.

According to the invention, the adhesive transfer device may further comprise a confirmation sound generating mechanism for generating a confirmation sound when the transfer surface of the second transfer section is pressed against the resilience of the spring member onto the transfer target surface over the entire area thereof. Preferably, the confirmation sound generating mechanism includes a pivotally movable member mounted coaxially with the pivot portion of the transfer head, and a resilient pawl member fixed at one end thereof to the case and intermittently engageable with the pivotally movable member when the transfer surface of the second transfer section is pressed onto the transfer target surface over the entire area thereof and generating a sound by oscillation upon intermittent engagement with the pivotally movable member. The pivotally movable member may be formed by the sector gear that can mesh with the supply gear which is mounted coaxially with the pivot portion of the supply reel and rotatable only in the unwinding direction of the transfer tape.

With this arrangement, when the transfer surface of the second transfer section is brought into contact with the transfer target surface, the transfer head pivots to turn the pivotally movable member in one direction. When the entire area of the transfer surface comes in contact with the transfer target surface, the pivotally movable member intermittently engages the resilient pawl member to thereby cause the resilient pawl member to generate a sound by oscillation. The thus generated sound enables the user to confirm that the entire area of the transfer surface of the second transfer section has come in contact with the transfer target surface. In the case where the pivotally movable member is formed by the sector gear that can mesh with the supply gear which is mounted coaxially with the pivot portion of the supply reel and rotatable only in the unwinding direction of the transfer tape, a transfer tape take-up_mechanism can share the same structural member with the confirmation sound generating mechanism.

Advantageous Effects of the Invention

By virtue of the foregoing structure, the adhesive transfer device of the present invention is able to achieve various advantageous effects, as enumerated below.

(1) According to the invention, since the adhesive of the transfer tape can be transferred onto the transfer target surface either in a spot-like fashion by pressing or stamping the transfer surface of the second transfer section onto the transfer target surface against the resilience of the spring member and subsequently moving the second transfer section back away from the transfer target surface, or alternatively in a linear fashion by moving the first transfer section on the transfer target surface with the first transfer section pressed onto the transfer target surface by the resilience of the spring member, spot-like transfer of the adhesive to the transfer target surface and linear transfer of the adhesive to the transfer target surface can be selectively performed by simple operation with high reliability.

(2) In addition to the advantageous effect mentioned in (1) above, according to the invention, movement of the first transfer section on the transfer target surface, which occurs after the first transfer section is forced against the transfer target surface, is made smooth and, hence, the linear transfer of the adhesive can be performed with greater ease.

(3) In addition to the advantageous effect mentioned in (1) and (2) above, according to the invention, when the transfer surface of the second transfer section is pressed onto the transfer target surface, surface irregularities of the transfer target surface are taken up or canceled by a synergetic effect generated by the resilience of the spring member and the elastic deformation of the elastic plate member, transfer of the adhesive onto the transfer target surface can be performed with improved reliability.

(4) Furthermore, according to the invention, it is possible to reduce contact friction between the transfer head and the transfer taper to thereby make the movement of the transfer tape smooth. In addition to the advantageous effect mentioned in (1) through (3) above, this will facilitate smooth movement of the transfer tape relative to the transfer head and improve the efficiency of the adhesive transfer operation.

(5) In addition to the advantageous effect mentioned in (1) through (4) above, according to the invention, since the transfer tape take-up mechanism is operated to take up the transfer tape in synchronism with a spot-like transfer operation, the transfer tape is kept from slacking, which will insure reliable transfer of the adhesive onto the transfer target surface.

(6) Furthermore, according to the invention, during the spot-like adhesive transfer operation, pivotal movement of the transfer head causes the pivotally movable member to move into intermittent engagement with the resilient pawl member and generate a sound by oscillation of the resilient pawl member. The thus generated sound enables the user to confirm that the entire area of the transfer surface of the second transfer section has come into contact with the transfer target surface. Thus, in addition to the advantageous effect mentioned in (1) through (5) above, the spot-like adhesive transfer operation can be achieved with high reliability. In the case where the pivotally movable member is formed by the sector gear that can mesh with the supply gear which is mounted coaxially with the pivot portion of the supply reel and rotatable only in the unwinding direction of the transfer tape, the confirmation sound generating mechanism can share the same structural member with the transfer tape take-up mechanism. This will achieve reduction in number of the structural members and downsizing of the adhesive transfer device.

BRIEF DESCRIPTION OF DRAWINGS

FIG. 3(*b*) is an enlarged cross-sectional view of a portion indicated by I in FIG. 3(*a*);

FIG. 3(*c*) is a rear cross-sectional view showing the main part of the adhesive transfer device;

FIG. 5(*b*) is a front elevational view of the transfer head;

FIG. 5(*c*) is a rear view of the transfer head;

DESCRIPTION OF REFERENCE CHARACTERS

Figure 1:
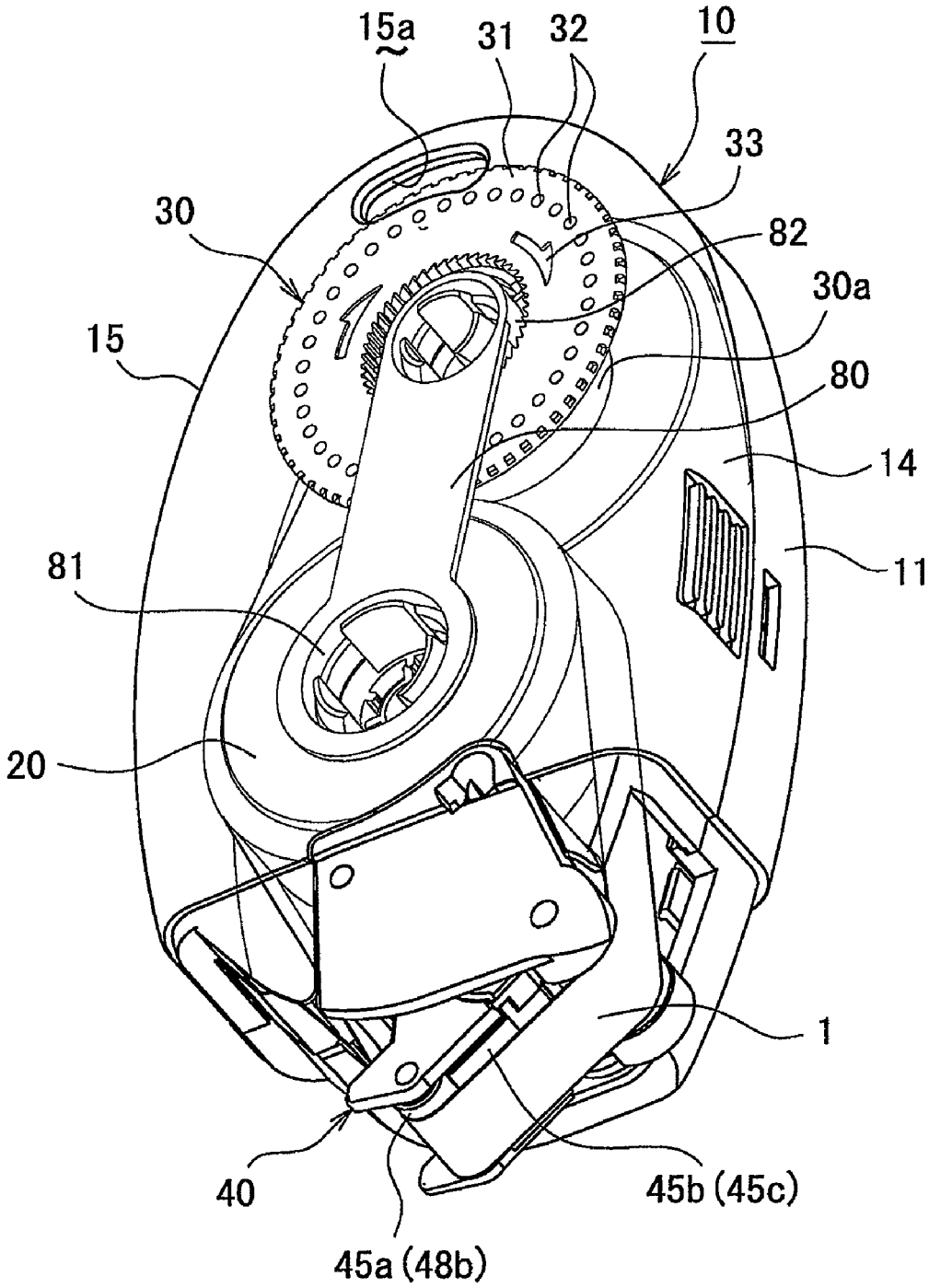
FIG. 1 is a schematic front perspective view showing a main part of an adhesive transfer device according to the present invention.

1: transfer tape
2: backing material
3: adhesive
4: transfer target surface
10: case
11: case body
14: partition plate
15: cover member
20: supply reel
30: take-up reel
40: transfer head
41: sector gear (pivotally movable member)
45*a*: first transfer section
45*b*: second transfer section
45*c*: transfer surface
46: spring member
48*b*: transfer roller
50: take-up mechanism
51: driving gear
52: supply gear
53: intermediate gear
54: driven gear
55: clutch mechanism
56: reverse rotation prevention mechanism
60: confirmation sound generating mechanism
61: resilient pawl member
90: cushion member (plate member)
101: first slippery cover member
102: second slippery cover member
103: third slippery cover member

BEST MODE FOR CARRYING OUT THE INVENTION

Figure 2:
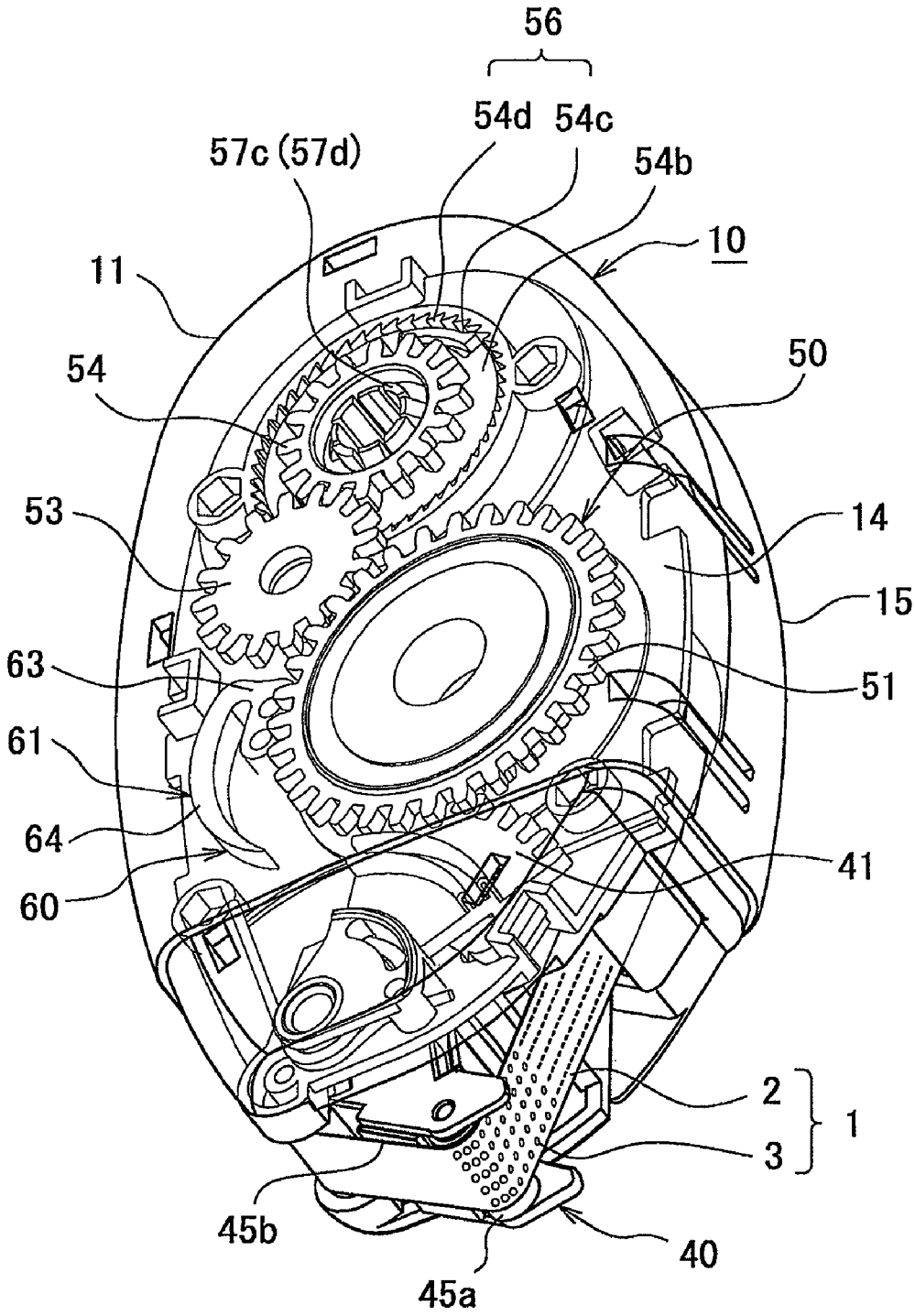
FIG. 2 is a schematic rear perspective view showing the main part of the adhesive transfer device.
Figure 3A:
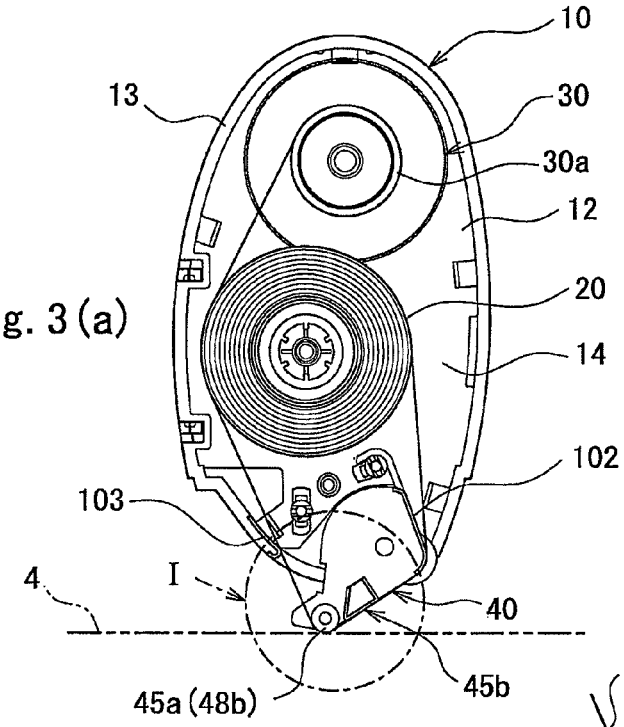
FIG. 3(*a*) is a front cross-sectional view showing the main part of the adhesive transfer device.
Figure 3B:
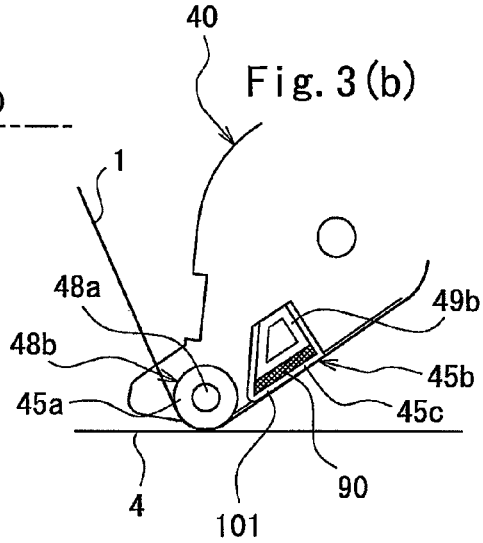
Figure 3C:
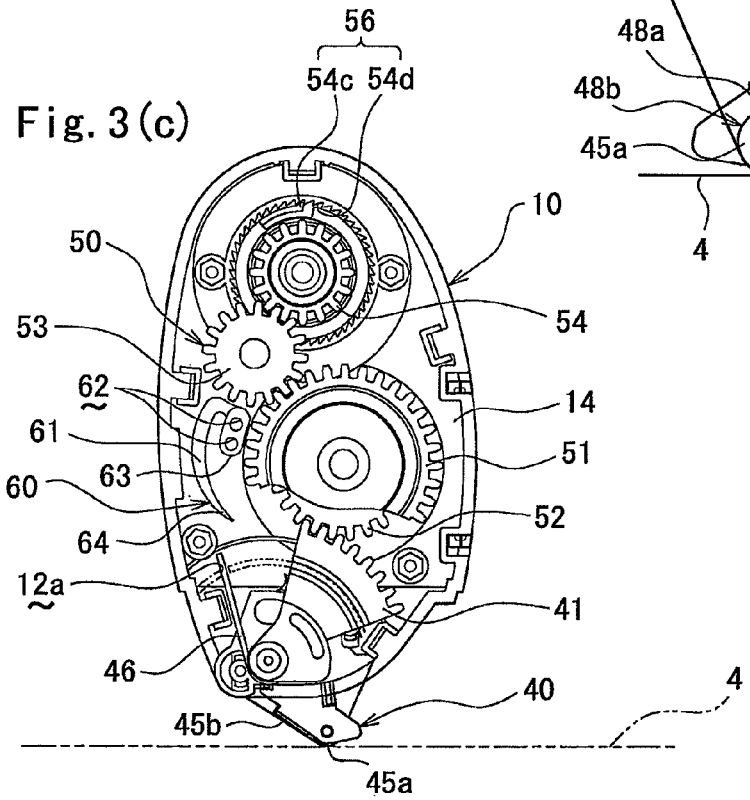

As shown in FIGS. 1 to 3, an adhesive transfer device according to the present invention generally comprises a case 10, a rotatable supply reel 20 on which is wound a transfer tape 1 having an adhesive 3 carried on one surface of a backing material 2, a rotatable take-up reel 30 for taking up a portion of the backing material 2 of the transfer tape 1 unwound from the supply reel 20, a transfer head 40 for transferring the adhesive 3 of the transfer tape 1 unwound from the supply reel 30 onto a transfer target surface 4, a take-up mechanism 50 for taking up the transfer tape 1 around the take-up reel 30, and a confirmation sound generating mechanism 60 for generating a confirmation sound when spot-like transfer is performed.

The transfer tape 1 is formed by a pressure-sensitive tape having a backing material 2 formed of a paper liner, for example, and an adhesive 3 consisting of acrylic pressure sensitive adhesive, for example, provided on one surface of the backing material 2 in a pattern arranged either zigzag or at regular intervals in both longitudinal and transverse directions of the backing material 2.

Figure 4:
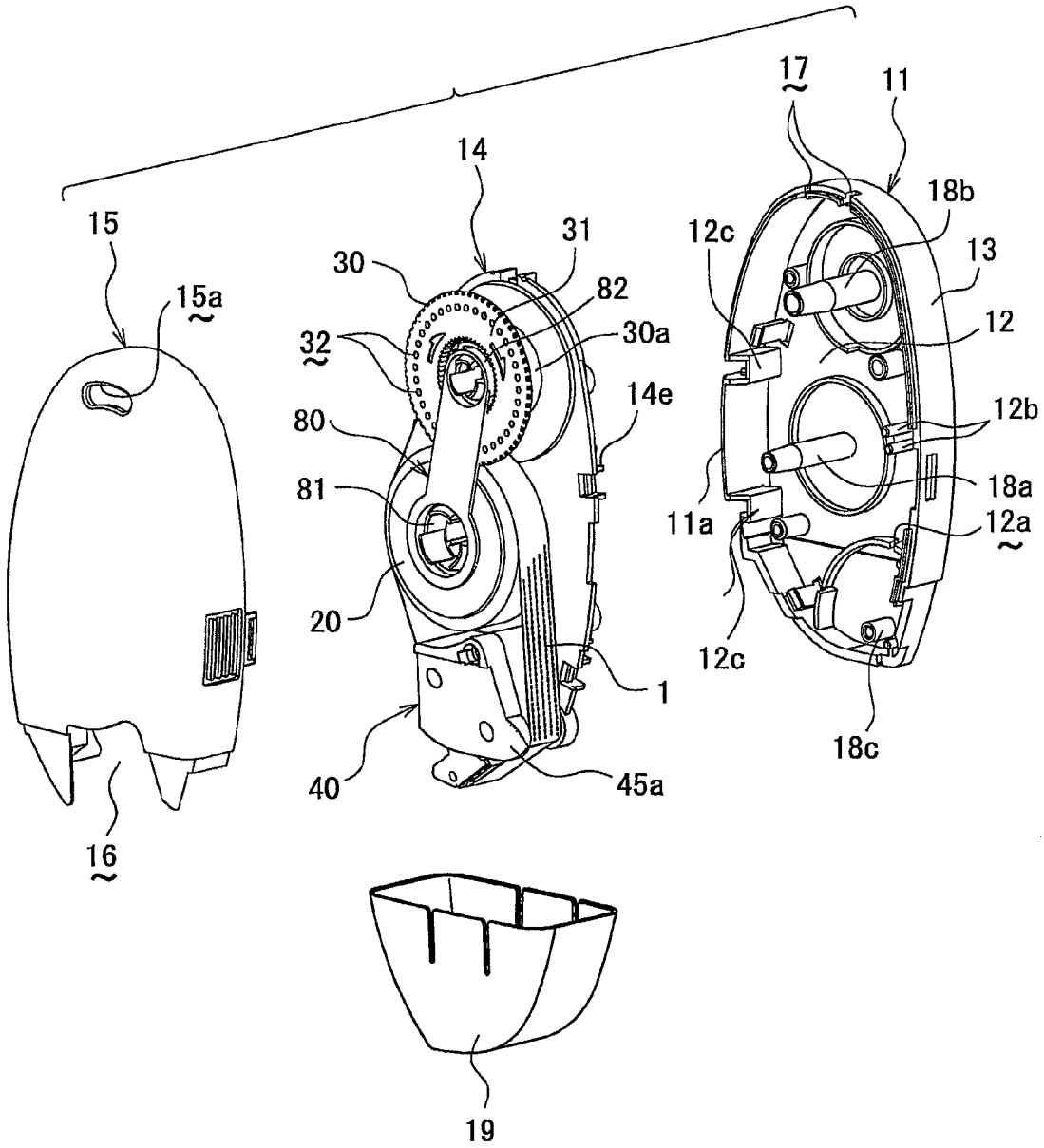
FIG. 4 is an exploded perspective view showing the main part of the adhesive transfer device.
Figure 5A:
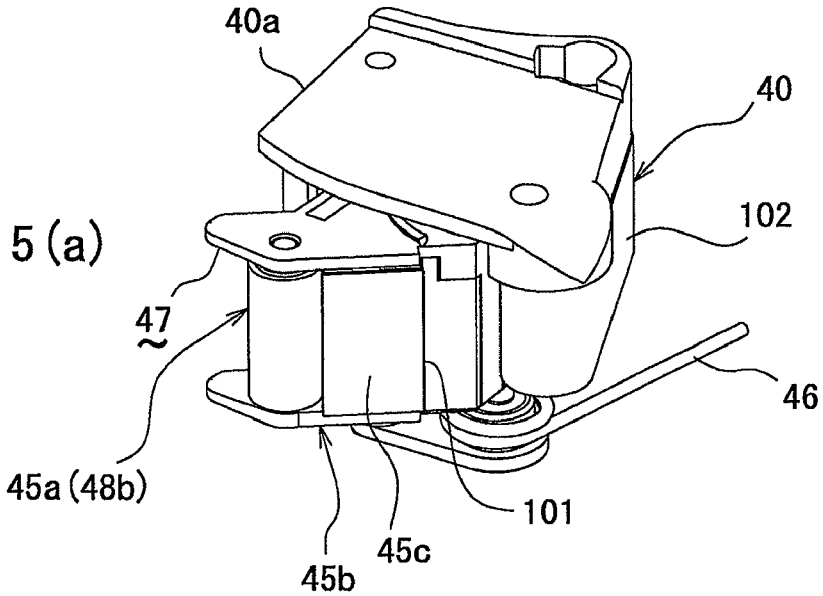
FIG. 5(*a*) is a perspective view showing a transfer head according to the present invention.
Figure 5B:
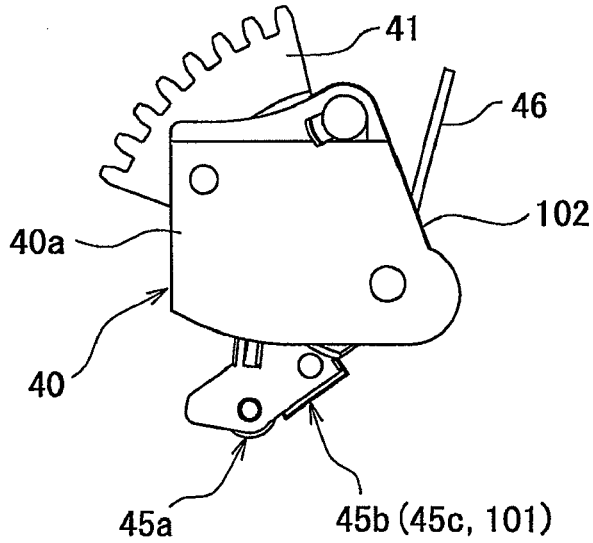
Figure 5C:
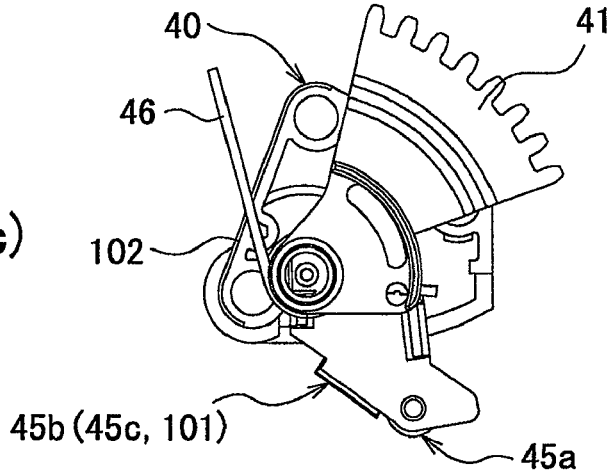
Figure 6:
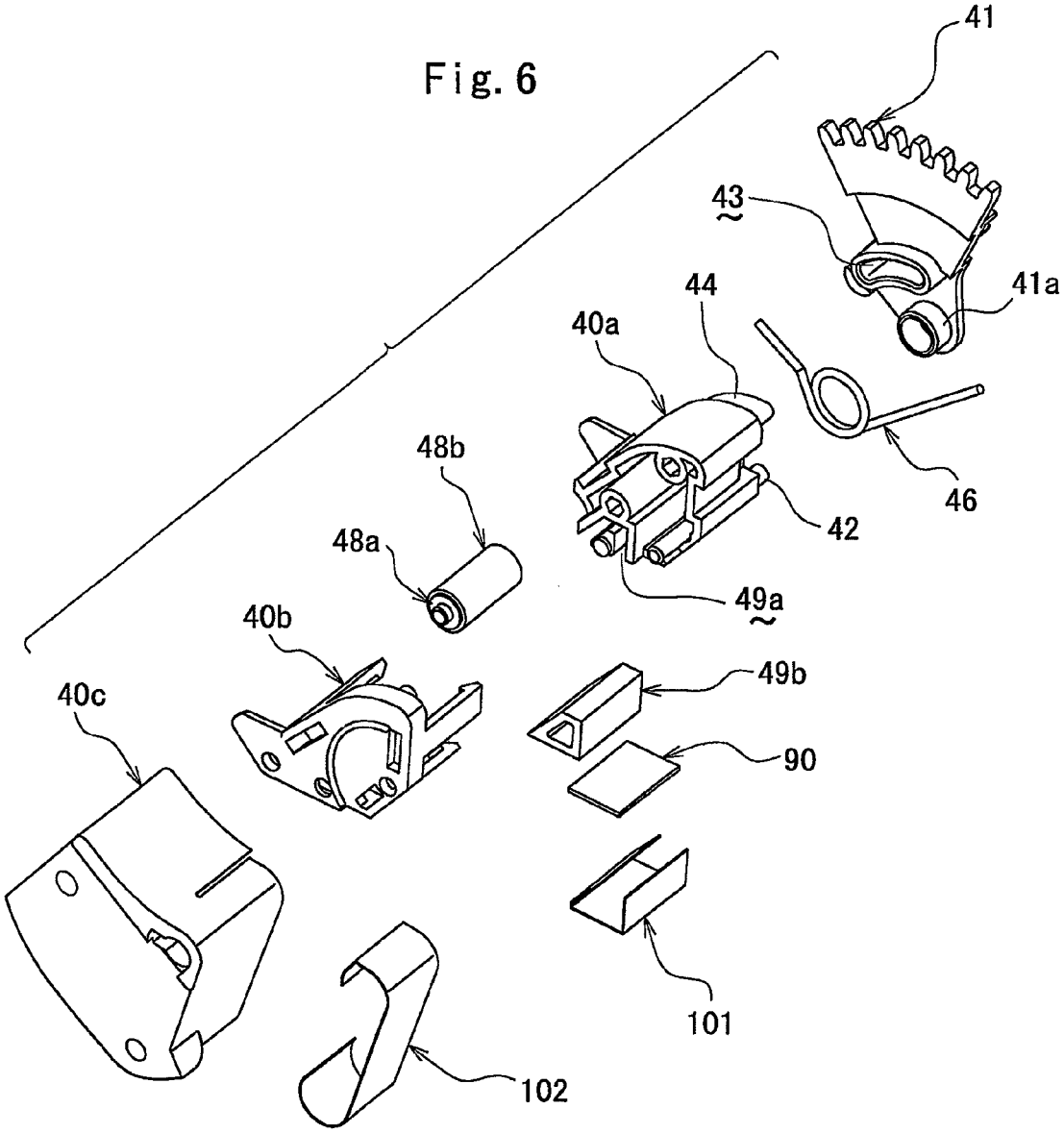
FIG. 6 is an exploded perspective view of the transfer head.

As shown in FIG. 4, the case 10 is formed by a case body 11 having a generally elliptical base portion 12 and an upstanding wall portion 13 extending along a periphery of the base portion 12, a partition plate 14 supporting thereon the supply reel 20, take-up reel 30 and transfer head 40 that are disposed inside the case 10, and a cover member 15 for covering an opening of the case body 11 such that the opening can be selectively opened and closed. In the illustrated embodiment, the case body 11 and the cover member 15 are formed from a transparent synthetic resin such as polystyrene resin. The cover member 15 has a recessed portion 16 formed at one end thereof for allowing the transfer head 40 to move into and out of the case 10 through the recessed portion 16. The partition plate 14 is formed from an opaque synthetic resin such as polyacetal resin. For enabling attachment and detachment of a replacement cartridge 70 described later, a pair of slits 17 is formed in the upstanding wall portion 13 of the case body 11 at an end of the case body 11 that is located remotely from the recessed portion 16.

The base portion 12 of the case body 11 is provided with a first support shaft 18*a* disposed at substantially the central portion of the base member 12 for rotatably supporting thereon the supply reel 20, a second support shaft 18*b* disposed at a position offset from the first support shaft 18*a* toward one end of the base portion 12 for rotatably supporting thereon the take-up reel 30, and a third support shaft 18*c* disposed adjacent to the opposite end of the base portion 12 located remotely from the second support shaft 18*b* for pivotally supporting thereon the transfer head 40.

Figure 7:
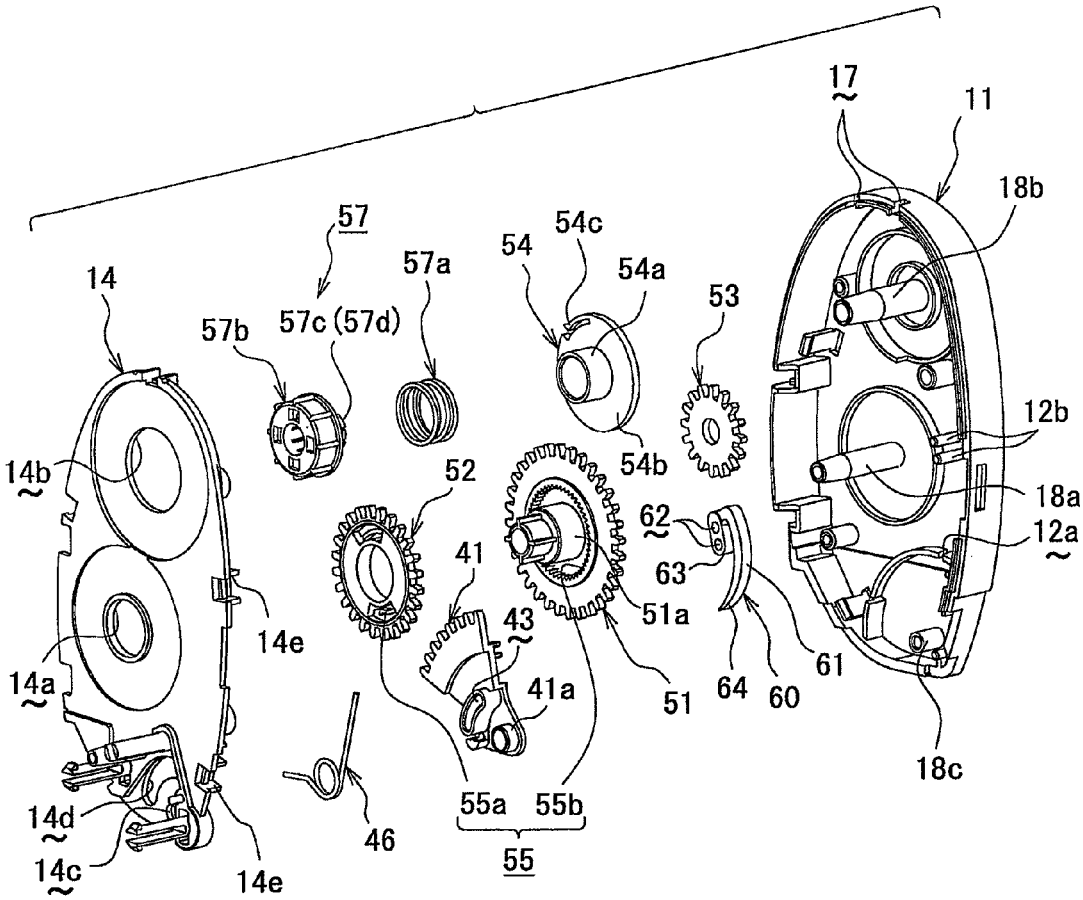
FIG. 7 is an exploded perspective view showing those members that form a supply reel, a take-up reel, a take-up mechanism and a confirmation sound generating mechanism according to the present invention.

A driving gear 51 and a supply gear 52 having a diameter smaller than that of the driving gear 51 are rotatably mounted on the first support shaft 18*a*. The driving gear 51 has a hub 51*a* provided protuberantly therefrom and rotatably mounted on the first support shaft 18*a*, and the supply reel 20 is removably mounted on the hub 51*a*. The supply gear 52 and the driving gear 51 have a built-in clutch mechanism which is configured to transfer a rotary motion to the supply reel 20 in a single direction (unwinding direction) to unwind the transfer tape 1 from the supply reel 20. As shown in FIG. 7, the clutch mechanism 55 includes a pair of arcuate, resiliently deformable ratchet pawls 55*a* provided concentrically on the supply gear 52 in diametrically opposite relation to each other, and an internal gear 55*b* formed concentrically on the driving gear 51 in such a manner as to allow the ratchet pawls 55*a* to come in meshing engagement with the internal gear 55*b*. By virtue of the clutch mechanism 55, when the supply gear 52 and a sector gear 41 described later are brought into meshing engagement with each other during spot-like transfer operation, the supply gear 52 is allowed to rotate without involving rotation of the supply reel 20.

A driven gear 54 is rotatably mounted on the second support shaft 18*b*. The driven gear 54 has a flanged hub 54*a* provided protuberantly therefrom and rotatably mounted on the second support shaft 18*b*, and the take-up reel 30 is removably mounted on the hub 54*a* via a reverse rotation preventing mechanism 56 and a brake mechanism 57.

In the illustrated embodiment, as shown in FIG. 2, the reverse rotation preventing mechanism 56 has a resiliently deformable latchet pawl 54*c* protruding from an outer periphery of a flange portion 54*b* formed integrally with the driven gear 54, and an internal gear 54*d* formed on a peripheral edge of a through-hole 14*b* of the partition plate 14 for meshing engagement with the ratchet pawl 54*c*, the through-hole 14*b* being loosely receptive of the hub 54*a*. The brake mechanism 57 includes a coil spring 57*a* loosely fitted around the hub 54*a* and having one end held in contact with the flange portion 54*b* of the driven gear 54, and a cap body 57*b* accommodating within it the coil spring 57*a* with the opposite end of the coil spring 57*a* held in contact with the cap body 57*b*. The cap body 57*b* has a leg portion 57*c* protruding therefrom for insertion into the hub 54*a* to the extent that a locking projection 57*d* formed at a free end of the leg portion 57*c* is in locking engagement with a peripheral edge of an opening of the hub 54*a*. With the brake mechanism 57 thus constructed, friction created by the resilience of the coil spring 57*a* can stabilize rotation of the take-up reel 30 in a condition which is free from wobbling.

The take-up reel 30 has a plurality of small holes 32 formed in a front-side flange 31 thereof at regular intervals along a peripheral edge of the flange 31. The flange 31 has an arrow mark 33 provided on a front surface thereof for indicating a take-up direction. By thus providing the small holes 32 and the arrow mark 33 on the flange 31 of the take-up reel 30, if the transfer tape 1 becomes slack during use, the user can manually take up the slack by turning the take-up reel 30 in the take-up direction using a pin (not shown) which is inserted though a window opening 15*a* formed in the cover member 15 of the case 10 into one of the small holes 32.

The sector gear 41 is rotatably mounted on the third support shaft 18*c*. The sector gear 41 has a central hub 41*a* provided protuberantly therefrom and rotatably mounted on the third support shaft 18*c*. A pivot shaft 42 projecting from one end of the transfer head 40 is fitted in the hub 41*a*. The sector gear 41 further has a circular arc-shaped grooved portion 43 formed in a concentric relation to the sector gear 41 and protruding from an intermediate portion of a front surface of the sector gear 41. A circular arc-shaped projection 44 formed on the transfer head 40 is fitted in an opening or groove formed in the circular arc-shaped grooved portion 43 so that the transfer head 40 and the sector gear 41 are integrated into a single unitary member.

The take-up mechanism 50 has the sector gear 41 mounted on a pivot portion of the transfer head 40, the supply gear 52 that can mesh with the sector gear 41 and is mounted coaxially with a cylindrical body of the supply reel 20 for transmitting rotation to the supply reel a single direction (unwinding direction) to unwind the transfer tape 1, the driving gear 51 mounted coaxially with the supply gear 52, and the driven gear 54 which is in driven mesh with the driving gear 51 via the intermediate gear 53 and mounted coaxially with a cylindrical body of the take-up reel 30.

With the take-up mechanism 50 thus constructed, when a transfer surface 45*c* of a second transfer section 45*b* of the transfer head 40 is pressed against the transfer target surface 4, the transfer head 40 undergoes pivotal movement to turn the sector gear 41 in one direction. Thus, the sector gear 41 first comes into meshing engagement with the supply gear 52 and then turns the supply gear 52 and the driving gear 51 concurrently while the supply reel 20 is kept immovable against rotation. Rotation of the driving gear 51 causes the driven gear 54 to rotate via the intermediate gear 53 in the take-up direction so that a portion of the transfer tape 1 extending between the transfer head 40 and the take-up reel 30 is taken up around the take-up reel 30. A slack of the transfer tape 1, which is produced due to forced pivotal movement of the transfer head 40 occurring against the force or resilience of the spring member 46 during the spot-like transfer of the adhesive, can thus be taken up or removed.

The sector gear 41, supply gear 52, driving gear 51, intermediate gear 53 and driven gear 54, which jointly form the take-up mechanism 50, are each formed by a material having high tensile and bending strengths, such as a polyacetal resin or the like synthetic resin.

Since the pivot shaft 42 of the transfer head 40 is fitted in the hub 41*a* of the sector gear 41 rotatably mounted on the third support shaft 18*c*, the transfer head 40 has one end pivotally supported on the third support shaft 18*c* protruding from the base portion 12 of the case 10. The transfer head 40 includes a first transfer section 45*a* formed at a free end portion thereof and having a circular arc-shaped contact surface for mutual contact with the transfer target surface 4, the second transfer section 45*b* disposed between the first transfer section 45*a* and the pivot portion (corresponding to the third support shaft 18*c*) and having a flat transfer surface 45*c*, and the spring member 46 for urging the free end portion of the transfer head 40 toward the transfer target surface 4. The transfer head 40 is made up of a head base member 40*a* including the circular arc-shaped projection 44 protruding from a rear surface thereof and engaged with the circular arc-shaped grooved portion 43 of the sector gear 41, a head front member 40*b* connected to a front surface side of the head base member 40*a*, and a head cover 40*c* fitted over the thus connected head base member 40*a* and head front member 40*b*. The head base member 40*a*, head front member 40*b* and head cover 40*c* are each formed of a member made from a synthetic resin such as impact-resistant polystyrene resin.

In the illustrated embodiment, the first transfer section 45*a* includes a rotary shaft 48*a* rotatably received in an opening 47 formed at the free end portion of the transfer head 40, and a transfer roller 48*b* of silicone resin fitted around an outer circumferential surface of the rotary shaft 48*a*.

The second transfer section 45*b* is formed by a headpiece 49*b* of trapezoidal shape in cross section fitted into a cutout groove 49*a* provided between the first transfer section 45*a* and the pivot portion of the transfer head 40. The headpiece 49*b* is formed from a synthetic resin such as impact-resistant polystyrene resin and has a front surface forming the transfer surface 45*c*. An elastic plate such as a cushion member 90 formed, for example, by a nonwoven fabric or a synthetic rubber is attached to the transfer surface 45*c*. The cushion member 90 has a front surface side, and a first slippery cover member 101 for smoothening movement of the transfer tape 1 is attached to the front surface side of the cushion member 90. The second transfer section 45*b* need not necessarily be formed by the headpiece 49*b* but may be formed integrally with the transfer head 40.

Furthermore, a second slippery cover member 102 for smoothening movement of the transfer tape 1 is attached to that part of the transfer head 40 which excludes the first transfer section 45*a* and which is subject to friction contact with the transfer tape 1. A third slippery cover member 103 for smoothening movement of the transfer tape 1 is also attached to that part of the recessed portion 16 of the cover member 15 which faces the first transfer section 45*a*.

By thus providing the first and second slippery cover members 101 and 102 on the transfer head 40 in combination with the third slippery cover member 103 provided on that part of the cover member 15 facing the first transfer section 45*a*, movement of the transfer tape 1 on and along the transfer head 40 is made smooth and the transfer tape 1 is protected against damage which may otherwise occur due to undue friction between itself and the transfer head 40.

The spring member 46 is formed by, for example, a torsion coil spring fitted loosely around the hub 41*a* of the sector gear 41 rotatably mounted on the third support shaft 18*c* and having one end engaged with a recessed locking portion 12*a* protruding from the base portion 12 of the case body 11, the other end of the torsion coil spring 46 being anchored by a portion of the transfer head 40. With the spring member 46 thus arranged, the free end portion of the transfer head 40 is urged by the force or resilience of the spring member 46 toward the transfer target surface 4. The spring member 46 may be formed by a spring other than the torsion coil spring provided that it can produce a resilient force tending to urge the free end portion of the transfer head 40 including the first transfer section 45*a* toward the transfer target surface 4.

The confirmation sound generating mechanism 60 includes a pivotally movable member, such as the sector gear 41, mounted coaxially with the pivot portion of the transfer head 40, and a resilient pawl member 61 fixed at one end thereof to the base portion 12 of the case body 11 and intermittently engageable with the sector gear 41 when the entire area of the second transfer section 45*b* is pressed onto the transfer target surface 4 and capable of generating a sound by oscillation upon intermittent engagement with the sector gear 41. In the illustrated embodiment, the resilient pawl member 61 is formed by a substantially elliptical fixed portion 63 having a pair of engagement holes 62 fitted respectively with a pair of retaining posts 12*b* protruding from the base portion 12 of the case body 11, and a pawl portion 64 extending downwards from an upper end of the fixed portion 63 to assume an arcuately curved configuration and terminating in a pointed end. The resilient pawl member 61 is formed from a resilient material having high tensile and bending strengths, such as a polyacetal resin or the like synthetic resin.

Since the confirmation sound generating mechanism 60 is comprised of the sector gear 41 and the resilient pawl member 61 as described above, the confirmation sound generating mechanism 60 shares the sector gear 41 with the take-up mechanism 50. Therefore, it is possible to reduce the number of structural components or members and downsize the adhesive transfer device.

For installation into the case body 11, the sector gear 41 forming a common part of the take-up mechanism 50 and confirmation sound generating mechanism 60, the supply gear 52, driving gear 51, intermediate gear 53, driven gear 54 and resilient pawl member 61 are mounted on the partition plate 14 in advance and subsequently they are placed into the case body 11 together with the partition plate 14.

More particularly, as shown in FIG. 4, the sector gear 41, supply gear 52, driving gear 51, intermediate gear 53, driven gear 54 and resilient pawl member 61 are disposed on one surface (rear surface) of the partition member 14 such that the hub 51*a* of the driving gear 51 is inserted through the through-hole 14*a* of the partition plate 14, the flanged hub 54*a* of the driven gear 54 is inserted through the through hole 14*b* of the partition plate 14, the hub 41*a* of the sector gear 41 is inserted through a through-hole 14*c* of the partition plate 14, and the circular arc-shaped grooved portion 43 of the sector gear 41 is inserted through a circular arc-shaped hole or opening 14*d* of the partition plate 14. Then, the supply reel 20 having the transfer tape 1 wound thereon and the take-up reel 30 that are rotatably held by a cartridge 80 is disposed on the other surface (front surface) of the partition plate 14.

Subsequently, the sector gear 41, supply gear 52, driving gear 51, intermediate gear 53, driven gear 54, resilient pawl member 61, supply reel 20 and take-up reel 30 carried on the partition plate 14 are accommodated within the case body 11. In this instance, resiliently deformable locking prongs 14*e* projecting from the rear surface of the partition plate 14 are brought into snapping engagement with recessed retaining portions 12*c* protruding from the base portion 12 of the case body 11 so that the partition plate 14 is secured to the case body 11 (see FIG. 4). Then, the cover member 15 is attached to the case body 11 to close an open side 11*a* of the cover body 11. Assembly of the adhesive transfer device is thus completed and the assembled adhesive transfer device now is in a ready-to-use state.

While the adhesive transfer device is not in use, a cap 19 formed from a synthetic resin material such as polypropylene is attached to a common side of the case body 11 and cover member 15 including the recessed portion 16 of the cover member 15 so that a portion of the transfer head 40 projecting from the recessed portion 16 of the cover member 15 is covered with the cap 19. The cap 19 is made transparent in the same manner as the case body 11 and cover member 15.

According to the foregoing construction, an internal space of the case 10 is divided by the opaque partition plate 14 into a front surface side and a rear surface side, and therefore, it is possible to place the sector gear 41, supply gear 52, driving gear 51, intermediate gear 53, driven gear 54 and resilient pawl member 61 on the rear surface side and also place the supply reel 20, take-up reel 30 and transfer tape 1 on the front surface side. With this arrangement, the supply reel 20, take-up reel 30 and transfer tape 1 can be visually observed through the transparent case 10 from the front surface side thereof. Similarly, the sector gear 41, supply gear 52, driving gear 51, intermediate gear 53, driven gear 54 and resilient pawl member 61 can be visually observed through the transparent case 10 from the rear surface side thereof.

Figure 10A:
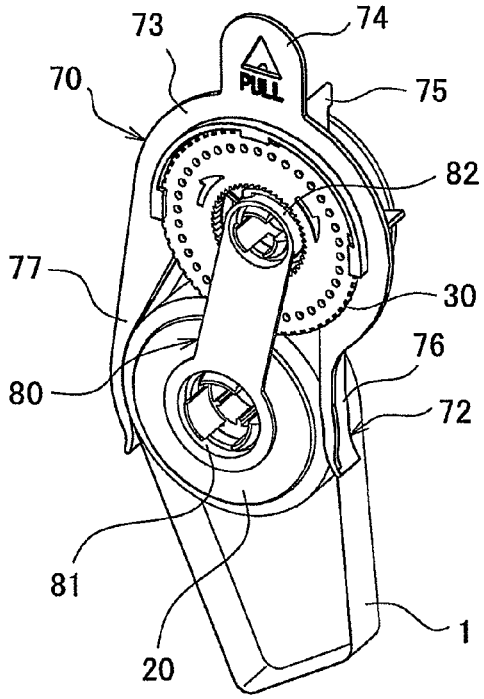
FIGS. 10(*a*) and 10(*b*) are perspective views showing a transfer tape cartridge and a replacement cartridge according to the present invention.
Figure 10B:
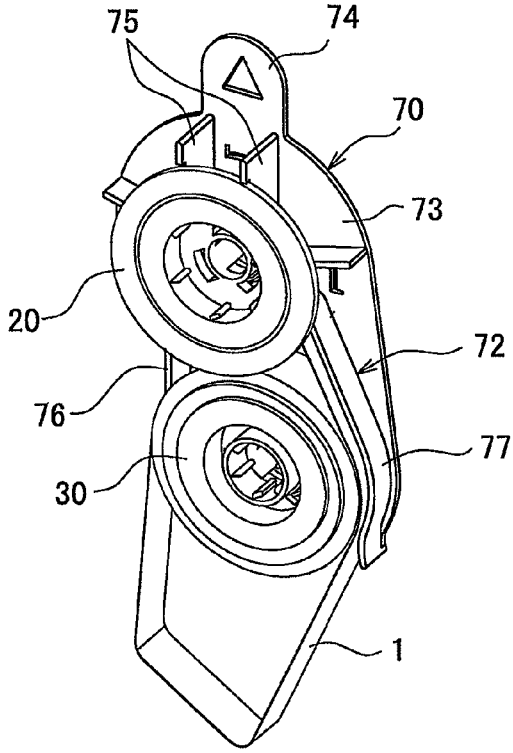

When the transfer tape 1 is to be replaced, as shown in FIG. 10, a replacement cartridge 70 is used. The replacement cartridge 70 is configured to temporarily hold a supply reel 20 and a take-up reel 30 that are locked in position by a pair of retaining prongs 81 and 82 of a cartridge 80. The supply reel 20 has a new transfer tape 1 wound thereon, and the take-up reel 30 is empty and has no backing material taken up thereon.

The replacement cartridge 70 is formed from a synthetic resin material such as polypropylene. As shown in FIG. 10, the replacement cartridge 70 includes a first holding portion 71 formed into a circular arc -shaped strip for holding an upper half part of a cylindrical body 30*a* of the take-up reel 30, a second holding portion 72 extending outwardly from opposite ends of the first holding portion 71 for holding the periphery of a roll of transfer tape 1 wound on the supply reel 20, a curved strip 73 projecting outwardly from one side edge of the first and second holding portions 71 and 72, a pull tab 74 extending from the curved strip 73 in a direction away from the first holding portion 71, and a pair of locking lugs 75 disposed in confronting relation on the curved strip 73 at a position located adjacent to the pull tab 74. In the illustrated embodiment, the second holding portion 72 is formed by a holding strip 76 extending linearly from one end of the first holding portion 71, and a curved holding strip 77 extending divergently from the other end of the first holding portion 71 and terminated in an inwardly curved distal end portion. The holding strip 76 and the curved holding strip 77 are resiliently deformable in a direction to move toward and away from each other for holding therebetween the periphery of the roll of transfer tape 1 wound on the supply reel 20.

Figure 11:
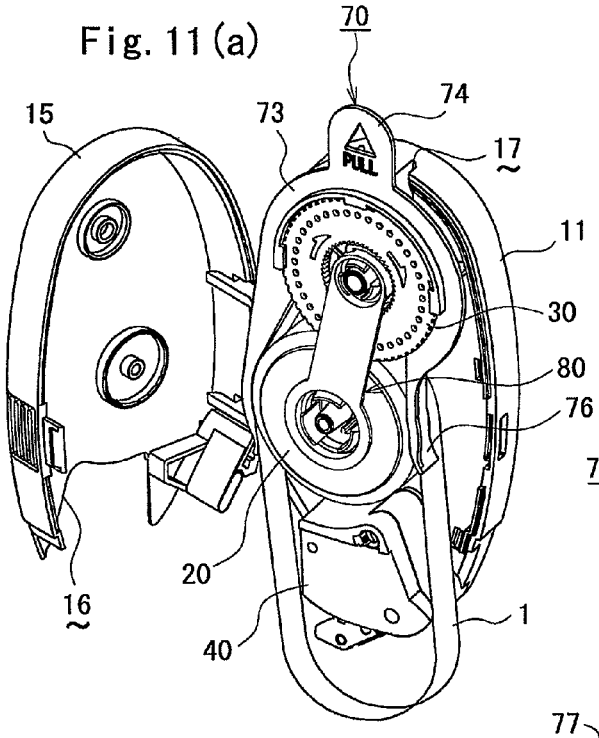
FIGS. 11(*a*) and 11(*b*) are schematic perspective views illustrative of a manner in which a transfer tape is replaced.
Figure 11:
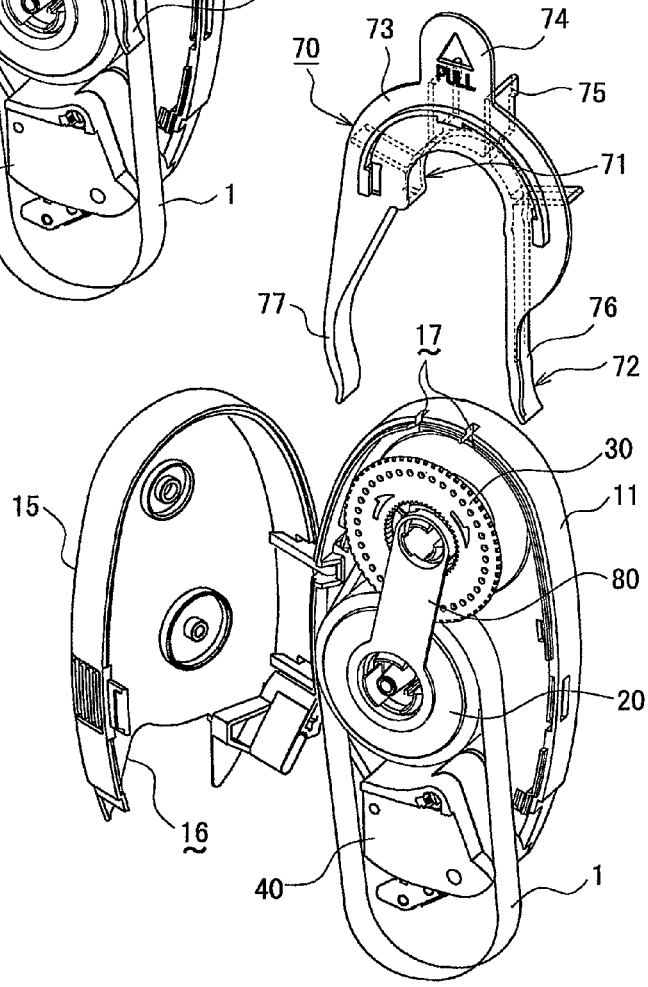

When the transfer tape 1 is to be replaced by using the replacement cartridge 70 of the foregoing construction, a supply reel 20 and a take-up reel 30 that are rotatably retained by the locking prongs 81, 82 at opposite ends of the tape cartridge 80 with a new transfer tape 1 wound on the supply reel are temporarily held by the replacement cartridge 70. Then, as shown in FIG. 11(*a*), the replacement cartridge 70 temporarily holding thereon the supply reel 20 and the take-up reel 30 with the new transfer tape 1 wound on the supply reel 20 is placed in the empty case body 11 with the cover body 15 opened. In this instance, the pair of locking lugs 75 of the replacement cartridge 70 are inserted in the pair of slits 17 formed in the upstanding wall portion 13 of the case body 11. Thereafter, the pull tab 74 projecting outward from the case body 11 is pulled to move the locking lugs 75 out of interlocking engagement with the slits 17 to thereby release the replacement cartridge 70 from a temporarily holding position, allowing for removal of the replacement cartridge 70 from the case body 11. Replacement of the transfer tape 1 is thus completed (see FIG. 11(*b*)). Then, the cover member 15 is closed to thereby place the adhesive transfer device in a ready-to-use condition.

Operation modes of the adhesive transfer device of the foregoing embodiment will next be described below in detail.

(Point-Like Transfer)

Figure 8A:
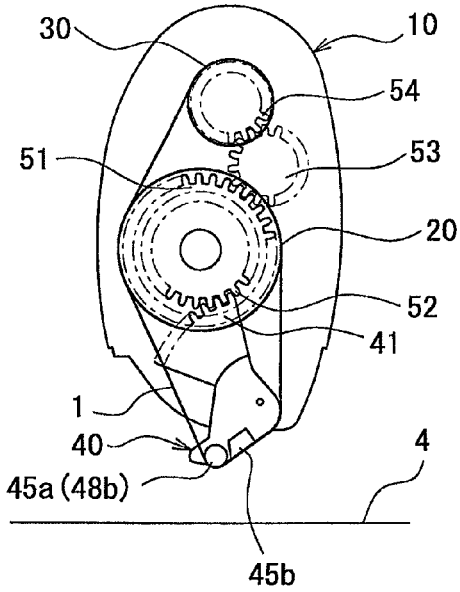
FIGS. 8(*a*), 8(*b*) and 8(*c*) are schematic cross-sectional views illustrative of a manner in which a spot-like transfer operation is performed, wherein FIG. 8(*a*) shows a pre-transfer condition, FIG. 8(*b*) shows a condition in which the spot-like transfer is being performed, and FIG. 8(*c*) shows a post-transfer condition.
Figure 8B:
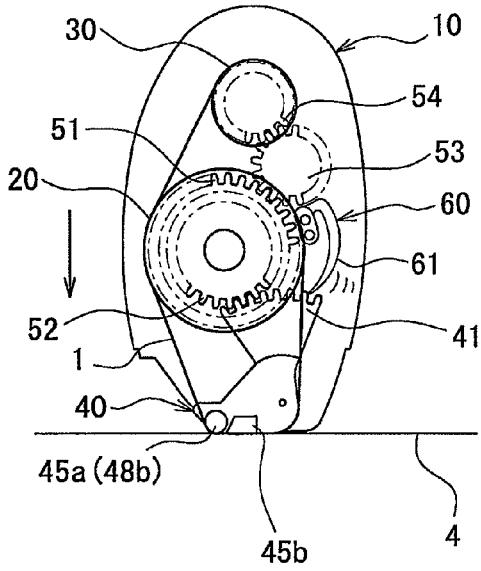
Figure 8C:
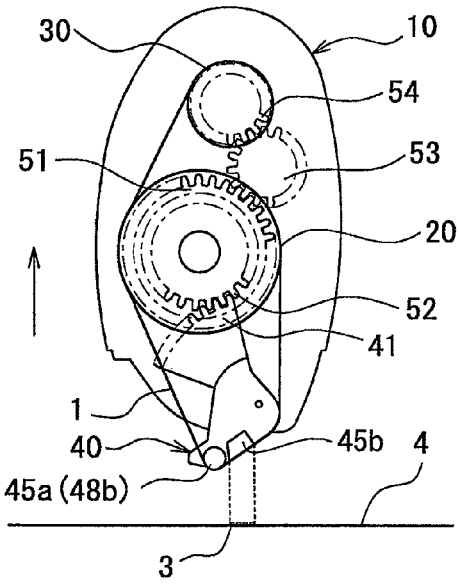
Figure 9A:
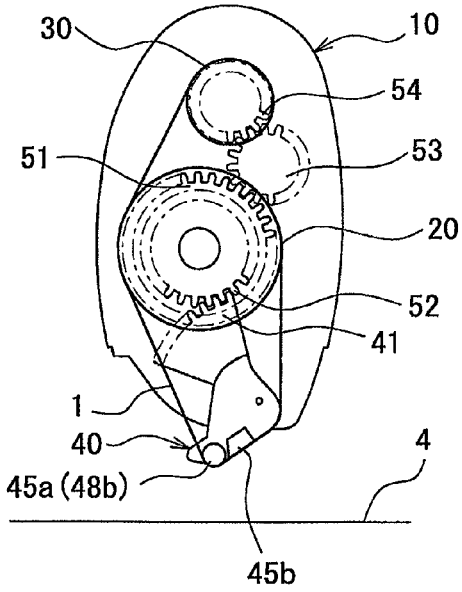
FIGS. 9(*a*), 9(*b*), 9(*c*) and 9(*d*) are schematic cross-sectional views illustrative of a manner in which a linear transfer operation is performed, wherein FIG. 9(*a*) shows a pre-transfer condition, FIG. 9(*b*) shows a condition at the start of the linear transfer operation, FIG. 9(*c*) shows a condition in which the linear transfer is being performed, and FIG. 9(*d*) shows a post-transfer condition.
Figure 9B:
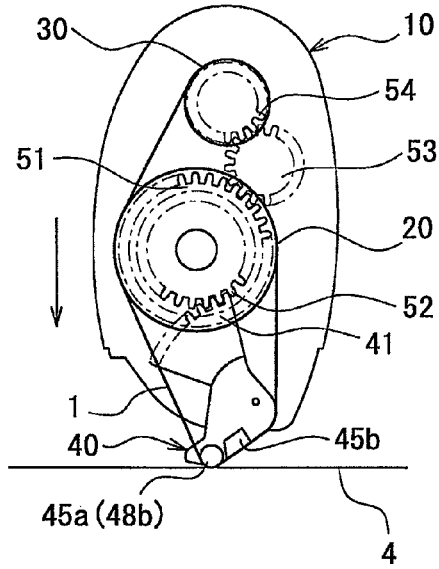
Figure 9C:
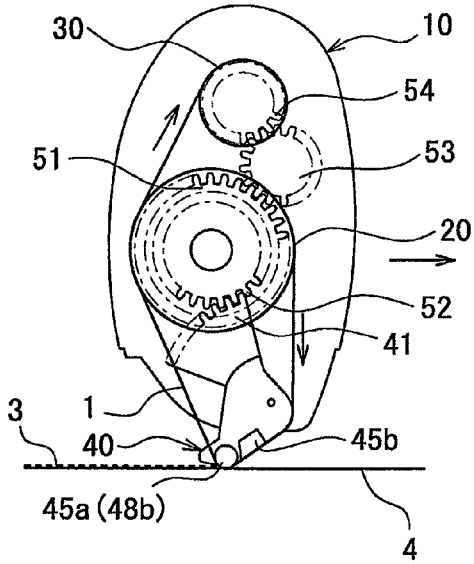
Figure 9D:
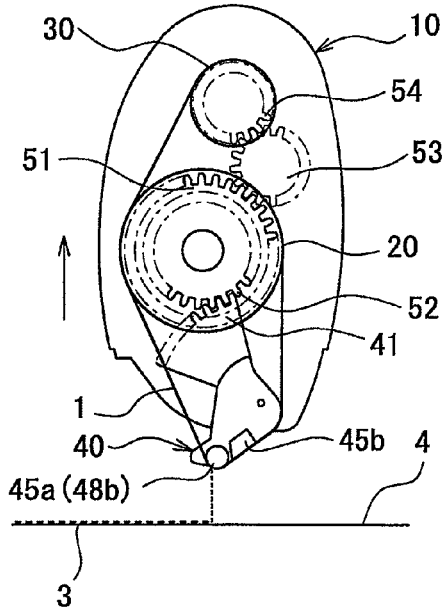

In order to perform spot-like transfer of the adhesive 3 onto the transfer target surface 4, first, the adhesive transfer device is placed above a desired transfer position on the transfer target surface 4 (see FIG. 8(*a*)).

Then, the free end of the transfer head 40, namely the first transfer section 45*a* is brought into contact with the transfer target surface 4, and while keeping this condition, the second transfer section 45*b* is brought into contact with the transfer target surface 4 against the resilience of the spring member 46 (see FIG. 8(*b*)). In this instance, the transfer head 40 pivots in a direction to turn, the sector gear 41 in one direction, and when the entire area of the transfer surface 45*c* comes in contact with the transfer target surface 4, the sector gear 41 comes in intermittent engagement with the pawl portion 64 of the resilient pawl member 61 and generates a click-like sound by oscillation of the resilient pawl member 61. By the click-like sound thus generated, the user is able to confirm that the entire area of the transfer surface 45*c* of the second transfer section 45*b* has been brought into mutual contact with the transfer target surface 4.

The angular movement of the sector gear 41 caused due to pivotal movement of the transfer head 40 brings the sector gear 41 into meshing engagement with the supply gear 52 and then turns the supply gear 52 and the driving gear 51 concurrently while the supply reel 20 is kept immovable against rotation. Rotation of the driving gear 51 causes the driven gear 54 to rotate via the intermediate gear 53 and the take-up reel 30 to also rotate in the take-up direction so that a portion of the transfer tape 1 (to be more precise, the backing material 2 of the transfer tape 1) extending between the take-up reel 30 and the free end portion of the transfer head 40 is taken up around the take-up reel 30. A slack of the transfer tape 1 occurring when the transfer head 40 pivots against the force or resilience of the spring member 46 can thus be taken up or removed.

Then, the second transfer section 45*b* is moved back away from the transfer target tape 4 and this movement enables the adhesive 3 of the transfer tape 1 to be transferred onto the transfer target surface 4 in a spot-like fashion (see FIG. 8(*c*)). By thus separating the second transfer section 45*b* away from the transfer target surface 4, the transfer head 40 and the sector gear 41 are allowed to pivot back to the original position by the resilience of the spring member 46. During that time, the sector gear 41 which is in mesh with the supply gear 52 turns the supply reel 20 and also turns the driving gear 51 concurrently with the supply gear 52. Rotation of the driving gear 51 causes the driven gear 54 to rotate via the intermediate gear 53 so that the transfer tape 1 is unwound from the supply reel 20 while, at the same time, the transfer tape 1 is taken up around the take-up reel 30. Thus, an unused part of the transfer tape 1 is set on the transfer head 40.

(Linear Transfer)

In order to perform linear transfer of the adhesive 3 onto the transfer target surface 4, the adhesive transfer device is first placed above a desired transfer position on the transfer target surface 4 (see FIG. 9(*a*)).

Then, the first transfer section 45*a* is brought into contact with the transfer target surface 4 and then depressed to such an extent that the first transfer section 45*a* is kept into pressure contact with the transfer target surface 4 by the resilience of the spring member 46 (see FIG. 9(*b*)). While keeping this condition, the adhesive transfer device is moved to advance in a direction parallel to the transfer target surface 4. During that time, as the first transfer section 45*a* advances in the same direction as the direction of advancing movement of the adhesive transfer device, the adhesive 3 of the transfer tape 4 is continuously transferred onto the transfer target surface 4 in linear fashion (see FIG. 9(*c*)) and, at the same, the transfer tape 1 is pulled out or unwound from the supply reel 20 while rotating the supply reel 20. Concurrently with this rotation of the supply reel 20, the driving gear 51 is rotated in a direction to rotate the driven gear 54 via the intermediate gear 53 in the take-up direction so that the transfer tape 1 (to be more precise, the backing material 2 of the transfer tape 1) is taken up around the take-up reel 30.

When a desired length of adhesive 3 has been transferred onto the transfer target surface, advancing movement of the adhesive transfer device is terminated and the first transfer section 45*a* is moved back away from the transfer target surface 4 (see FIG. 9(*d*)). The adhesive 3 of the transfer tape 1 thus transferred onto the transfer target surface 4 takes the form of a continuous rectilinear strip of adhesive material of desired length.

Although in the illustrated embodiment discussed above, the adhesive 3 of the transfer tape 1 is provided on the backing material 2 in a pattern arranged either zigzag or at regular intervals in both longitudinal and transverse directions of the backing material 2, arrangement of the adhesive 3 should by no means be limited to the one shown in the illustrated embodiment but may include any other pattern in which the adhesive is carried on one surface of a backing material 2 in the form of, for example, a plurality of parallel spaced strips of adhesive material provided at predetermined intervals along the length of the backing material 2, or a row of pieces of adhesive material having a smaller surface area than the transfer surface 45*c*.

INDUSTRIAL APPLICABILITY

According to the invention, since the adhesive of the transfer tape can be transferred onto the transfer target surface either in a spot-like fashion by pressing or stamping the transfer surface of the second transfer section onto the transfer target surface against the resilience of the spring member and subsequently moving the second transfer section back away from the transfer target surface, or alternatively in a linear fashion by moving the first transfer section on the transfer target surface with the first transfer section pressed onto the transfer target surface by the resilience of the spring member, spot-like transfer of the adhesive to the transfer target surface and linear transfer of the adhesive to the transfer target surface can be selectively performed by simple operation with high reliability.

The invention claimed is:

1. An adhesive transfer device including a case, a supply reel rotatably mounted to the case and having a wound supply of transfer tape wound thereon, the transfer tape having a backing material and an adhesive provided on one surface of the backing material, a take-up reel rotatably mounted to the case for taking up a portion of the backing material of the transfer tape unwound from the supply reel, and a transfer head mounted to the case for transferring the adhesive of the transfer tape unwound from the supply reel onto a transfer target surface, characterized in that said transfer head has one end pivotally connected to the case and includes a first transfer section provided at a free end portion of the transfer head and having a circular arc-shaped contact surface for mutual contact between the first transfer section and the transfer tape, a second transfer section disposed between the first transfer section and a pivot portion of the transfer head and having a flat transfer surface, and a spring member for urging the free end portion of the transfer head toward the transfer target surface, wherein the transfer head is configured to selectively perform either of point-like transfer of the adhesive onto the transfer target surface by first pressing the second transfer section onto the transfer target surface against the resilience of the spring member and subsequently moving the second transfer section back away from the transfer target surface, and linear transfer of the adhesive onto the transfer target surface by moving the first transfer section with the first transfer section pressed onto the transfer target surface by the resilience of the spring member.

2. An adhesive transfer device according to claim 1, wherein the first transfer section comprises a roller rotatably mounted to the transfer head.

3. An adhesive transfer device according to claim 1, wherein the flat transfer surface of the second transfer section is formed by an elastic plate member.

4. An adhesive transfer device according to claim 1, wherein a slippery cover member for smoothening movement of the transfer tape is attached to each of the transfer surface of the second transfer section and that part of the transfer head which excludes the first transfer section and which is subjected to mutual contact with the transfer tape.

5. An adhesive transfer device according to claim 1, further comprising a take-up mechanism for taking up the transfer tape around the take-up reel when the second transfer section is moved back away from the transfer target surface, wherein the take-up mechanism includes a sector gear mounted coaxially with the pivot portion of the transfer head, a supply gear that can mesh with the sector gear and is mounted coaxially with a cylindrical body of the supply reel for transmitting a rotary motion to the supply reel only in an unwinding direction of the transfer tape, a driving gear mounted coaxially with the supply gear, and a driven gear held in driven mesh with the driving gear via an intermediate gear and mounted coaxially with a cylindrical body of the take-up reel.

6. An adhesive transfer device according to claim 5, further comprising a confirmation sound generating mechanism for generating a confirmation sound when the transfer surface of the second transfer section is pressed against the resilience of the spring member onto the transfer target surface over the entire area thereof, wherein the confirmation sound generating mechanism includes a pivotally movable member mounted coaxially with the pivot portion of the transfer head, and a resilient pawl member fixed at one end thereof to the case and intermittently engageable with the pivotally movable member when the transfer surface of the second transfer section is pressed onto the transfer target surface over the entire area thereof and generating a sound by oscillation upon intermittent engagement with the pivotally movable member.

7. An adhesive transfer device according to claim 4, further comprising a take-up mechanism for taking up the transfer tape around the take-up reel when the second transfer section is moved back away from the transfer target surface, wherein the take-up mechanism includes a sector gear mounted coaxially with the pivot portion of the transfer head, a supply gear that can mesh with the sector gear and is mounted coaxially with a cylindrical body of the supply reel for transmitting a rotary motion to the supply reel only in an unwinding direction of the transfer tape, a driving gear mounted coaxially with the supply gear, and a driven gear held in driven mesh with the driving gear via an intermediate gear and mounted coaxially with a cylindrical body of the take-up reel.

8. An adhesive transfer device according to claim 7, further comprising a confirmation sound generating mechanism for generating a confirmation sound when the transfer surface of the second transfer section is pressed against the resilience of the spring member onto the transfer target surface over the entire area thereof, wherein the confirmation sound generating mechanism includes a pivotally movable member mounted coaxially with the pivot portion of the transfer head, and a resilient pawl member fixed at one end thereof to the case and intermittently engageable with the pivotally movable member when the transfer surface of the second transfer section is pressed onto the transfer target surface over the entire area thereof and generating a sound by oscillation upon intermittent engagement with the pivotally movable member.

9. An adhesive transfer device according to claim 8, wherein the pivotally movable member comprises the sector gear that can mesh with the supply gear which is mounted coaxially with the pivot portion [sic] of the supply reel and rotatable only in the unwinding direction of the transfer tape.

10. An adhesive transfer device according to claim 1, further comprising a confirmation sound generating mechanism for generating a confirmation sound when the transfer surface of the second transfer section is pressed against the resilience of the spring member onto the transfer target surface over the entire area thereof, wherein the confirmation sound generating mechanism includes a pivotally movable member mounted coaxially with the pivot portion of the transfer head, and a resilient pawl member fixed at one end thereof to the case and intermittently engageable with the pivotally movable member when the transfer surface of the second transfer section is pressed onto the transfer target surface over the entire area thereof and generating a sound by oscillation upon intermittent engagement with the pivotally movable member.

11. An adhesive transfer device according to claim 4, further comprising a confirmation sound generating mechanism for generating a confirmation sound when the transfer surface of the second transfer section is pressed against the resilience of the spring member onto the transfer target surface over the entire area thereof, wherein the confirmation sound generating mechanism includes a pivotally movable member mounted coaxially with the pivot portion of the transfer head, and a resilient pawl member fixed at one end thereof to the case and intermittently engageable with the pivotally movable member when the transfer surface of the second transfer section is pressed onto the transfer target surface over the entire area thereof and generating a sound by oscillation upon intermittent engagement with the pivotally movable member.

12. An adhesive transfer device according to claim 10, wherein the pivotally movable member comprises the sector gear that can mesh with the supply gear which is mounted coaxially with the pivot portion [sic] of the supply reel and rotatable only in the unwinding direction of the transfer tape.

13. An adhesive transfer device according to claim 11, wherein the pivotally movable member comprises the sector gear that can mesh with the supply gear which is mounted coaxially with the pivot portion [sic] of the supply reel and rotatable only in the unwinding direction of the transfer tape.

14. An adhesive transfer device according to claim 6, wherein the pivotally movable member comprises the sector gear that can mesh with the supply gear which is mounted coaxially with the pivot portion [sic] of the supply reel and rotatable only in the unwinding direction of the transfer tape.

* * * * *